US008388044B2

(12) United States Patent
Saito et al.

(10) Patent No.: US 8,388,044 B2
(45) Date of Patent: Mar. 5, 2013

(54) AFFIXING STRUCTURE FOR FIXING A WINDOW GLASS TO A CARRIER PLATE, AND A WINDOW REGULATOR USING THE AFFIXING STRUCTURE

(75) Inventors: Naohiro Saito, Hino (JP); Takashi Saito, Kariya (JP); Hodaka Matsuura, Kariya (JP); Kyouhei Yamada, Shisou (JP)

(73) Assignees: Aisin Seiki Kabushiki Kaisha, Aichi-ken (JP); Hi-Lex Corporation, Hyogo-ken (JP)

( * ) Notice: Subject to any disclaimer, the term of this patent is extended or adjusted under 35 U.S.C. 154(b) by 251 days.

(21) Appl. No.: 12/884,304

(22) Filed: Sep. 17, 2010

(65) Prior Publication Data

US 2011/0068609 A1 Mar. 24, 2011

(30) Foreign Application Priority Data

Sep. 18, 2009 (JP) ..... 2009-216833

(51) Int. Cl.
*B60J 1/08* (2006.01)

(52) U.S. Cl. ..... 296/146.2; 296/201

(58) Field of Classification Search ..... 296/146.2, 296/201

See application file for complete search history.

(56) References Cited

U.S. PATENT DOCUMENTS

2004/0154227 A1* 8/2004 Yoshimura ..... 49/352
2009/0038227 A1* 2/2009 Costigan et al. ..... 49/352
2009/0064590 A1* 3/2009 Sasaki et al. ..... 49/350

FOREIGN PATENT DOCUMENTS

JP 2004-68506 A 3/2004
JP 2007-278061 A 10/2007

* cited by examiner

*Primary Examiner* — Lori Lyjak
(74) *Attorney, Agent, or Firm* — Cheng Law Group, PLLC

(57) ABSTRACT

This invention is to provide the affixing structure and the window regulator using the affixing structure, that has simple structure and that can smoothly fix the window glass to the carrier plate. The affixing structure 17 comprises a carrier plate 18 and a glass holder 16. The carrier plate 18 has a base portion 22*a* for placing the glass holder 16, a guide portion 22*b* which protrudes from the side edge of the base portion 22*a* and which has a inclined surface 22*e* slanted downwardly heading the placement face, and a fixing portion 22*c* which projects downwardly from other side edge of the base portion 22*a*. The glass holder 16 has a bottom part 16*a* to he placed on the base portion 22*a*, and a fixing part 16*b* which projects downwardly from the from the side edge and which contacts with a periphery of the fixing portion of the carrier plate. The bottom part 16*a*of the glass holder 16 meets the top of the inclined surface 22*e* before the edge of the fixing part 16*b*meets the base portion 22*a* while lowering the glass holder 16.

7 Claims, 6 Drawing Sheets

AFFIXING STRUCTURE FOR FIXING A WINDOW GLASS TO A CARRIER PLATE, AND A WINDOW REGULATOR USING THE AFFIXING STRUCTURE

TECHNICAL FIELD

Present invention relates to an affixing structure for fixing a window glass to a carrier plate. Specifically, this invention relates to the affixing structure which can easily fix the window glass to the carrier plate and a window regulator using this structure.

BACKGROUND OF THE INVENTION

One example of the affixing structure for fixing the window glass to the carrier plate is shown in FIG. 6. This affixing structure 100 comprises the glass holder 102 for supporting the window glass 101 and the carrier plate 103 to be fixed to the glass holder 102. The carrier plate 103 has the guide portion 104 protruding obliquely upward heading window glass. On the other hand, the glass holder 102 has the insertion part 105 protruding obliquely downward heading the carrier plate. The insertion part 105 is guided along by the guide portion 104 of the carrier plate 103.

Another example of the affixing structure for fixing the window glass to the carrier plate is shown in FIG. 7. This affixing structure 110 comprises the glass holder 111 to be attached to the bottom end of the window glass and the carrier plate 112 for supporting the glass holder 111. The glass holder 111 has the leg part 111*a* protruding downward. The carrier plate 112 has the holder fixing part 113, 113 on its both side ends. The holder fixing part 113 has the fixing surface 113*a* which meets with the back of the glass holder 111, the stepped part 113*b* formed on the top of the fixing surface 113*a*, the back guide 113*c* protruding upward from the back end of the stepped part 113*b*. Further, one of the holder fixing part 113 (left side of figure) has the side surface 113*d* which stands from the left and right side of the fixing surface 113*a*, and front surface 113*e* which couples the front edge of the side surface 113*d*. The inner surface of both side surfaces 113*d*, 113*d* are tapered so as the width or the opening formed by the inner surface of the side surfaces 113*d* is continuously narrow heading downward.

According to this affixing structure 110, the front and back direction of the leg part 111*a* are guided by the front surface 113*e* and both back guide 113*c* formed left and right, and the left and right direction of the leg part are guided by the side surface 113*d*, when the glass holder 111 is brought down or lowered for fixing the glass holder 111 to the holder fixing part 113. Further, the leg part 111*a* may be temporary laid on the stepped part 113*b*, 113*b* before glass holder 111 is completely fixed to the holder fixing part 113. Therefore, it is one of this characteristic features that the worker can adjust the position of the window glass during this temporary position before the final fixing.

However, the affixing structure 100 of FIG. 6 has to set the guide portion 104 to the both side of the carrier plate 103 which makes the structure complicated. On the other hand, the affixing structure 110 of FIG. 7 sometimes has handling jam that the ends of the leg part 111*a*, 111*a* hit the stepped part 113*b*, 113*b* which interrupt the smooth handling of the glass holder 111 attachment.

[Prior Art]

[Patent literature 1] Published Japanese Patent Application 2007-278061

[Patent literature 2] Published Japanese Patent Application 2004-68506

SUMMARY OF THE INVENTION

Therefore, this invention is directed to provide the affixing structure and the window regulator using the affixing structure, that has simple structure and that can smoothly fix the window glass to the carrier plate.

The affixing structure of this invention is used for a window regulator which is fixed to a carbody and which reciprocate the window glass by an inner cable. The affixing structure comprises a glass holder to be fixed to a bottom end of the window glass and the carrier plate supporting the glass holder. The carrier plate includes a base portion having a placement face for placing the glass holder, a guide portion which protrudes from one side edge of the placement face and which has a inclined surface formed on a top of the guide portion slanted downwardly heading the placement face, and a fixing portion which projects downwardly from other side edge of the placement face. The glass holder includes a bottom part to be placed on the placement face, a fixing part which projects downwardly from the bottom part and which contacts with a periphery of the fixing portion for fixing. When glass holder is lowered or brought down for placing the glass holder on the carrier plate, the bottom part of the glass holder meets the inclined surface of the guide portion of the carrier plate, and then the bottom part of the glass holder is guided toward the placement face, before a front edge of the fixing part meets the placement face.

The window regulator of this invention includes a cable guide each set on a top and a bottom, an inner cable stretched or installed between the cable guides, a driving unit to drive the inner cable, and the above affixing structure for fixing the window glass to the carrier plate.

According to the affixing structure of this invention, the bottom part and the fixing part of the glass holder are guided by the inclined surface of the guide portion during the lowering of the glass holder for placing the glass holder on the carrier plate. Therefore, the bottom part can be directly set on the placement face without the fixing part to meet the placement face, and the placement procedure can be executed smoothly.

The affixing structure may have the height of the guide portion same with or larger than the height of the fixing part, may have the width of the bottom part same with or lager than the width of the base portion, and may have the horizontal distance which the glass holder is guided by the inclined surface of the guide portion same with or larger than the width of the bottom part, to execute the placement procedure more smoothly.

The guide portion and the fixing portion may be formed on both left and right side of a cable latching portion of the carrier plate, and the fixing part may be formed on the glass holder corresponding to the guide portion and the fixing portion. Therefore, the carrier plate will not circle around the meeting point, when or after the fixing portion meets the fixing part in result to the natural descendent of the guide portion by weight of window glass. Resultantly, the temporary position is stable and the whole assembling procedure can be efficiently executed.

According to the window regulator of this invention, since it includes the affixing structure of window glass and the carrier plate, the assured support of the window glass can be obtained.

DETAIL DESCRIPTION OF THE INVENTION

Figure 1:
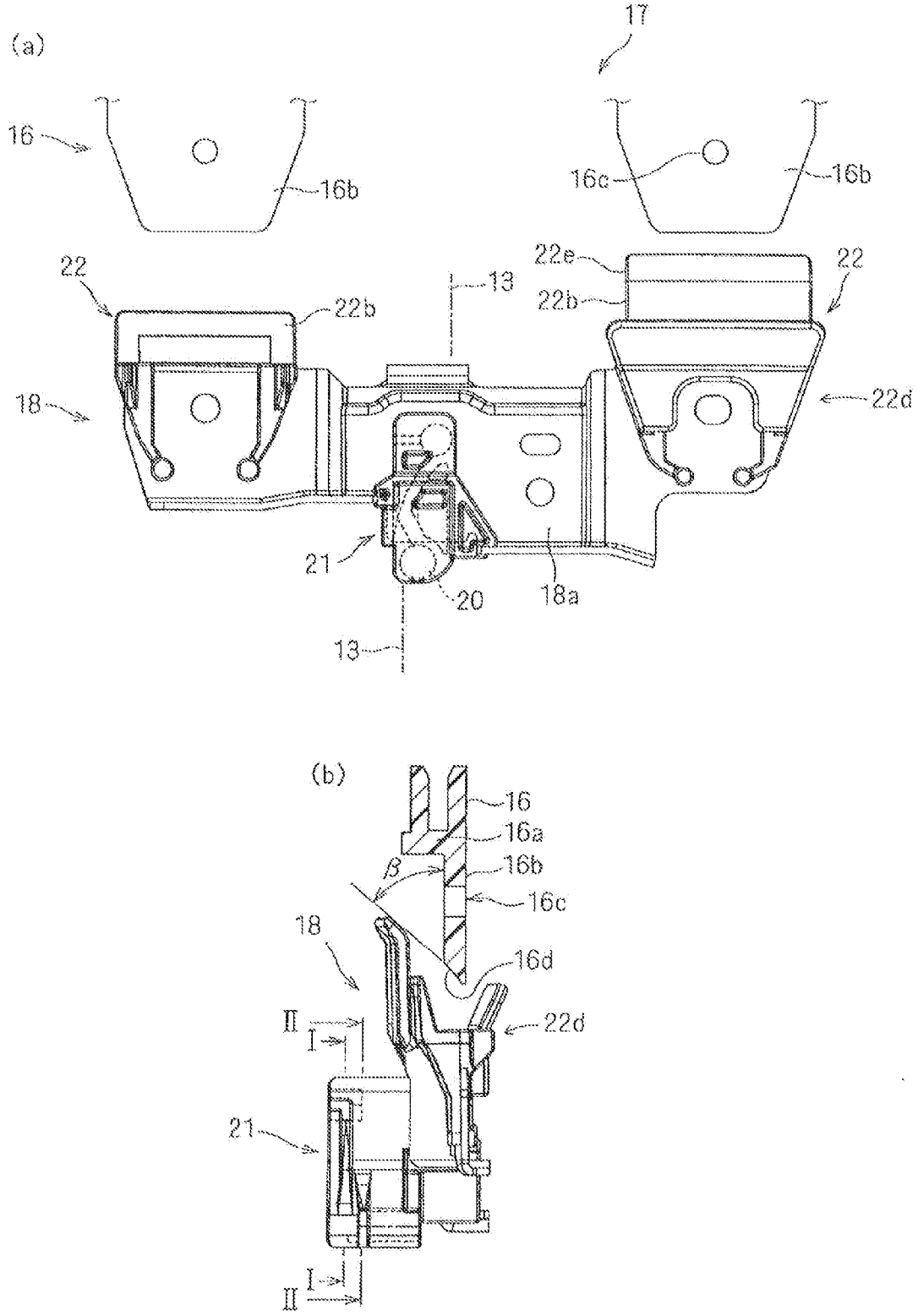
FIG. 1*a* is a front view of the affixing structure of this invention.
FIG. 1*b* is a side view of the FIG. 1*a* with the glass holder showed in cross-section.

FIG. 2*a*, 2*b* shows the window regulator which includes the affixing structure of the present invention. The window regulator of FIG. 2*a* comprises, the guide rail 11, 11 set on left and right as a pair; the cable guide 12 set on the top and bottom of the each guide rail; the inner cable 13 stretched between the cable guide set on the left, right, top, and bottom in the shape of 8; the outer casing 14 to guide the inner cable 13; the carrier plate 18, 18' which is coupled to the inner cable 13 between top and bottom of the cable guide 12 and which support the window glass 15; the drive unit 19 to drive the inner cable 13. The bottom end of the window glass 15 is equipped with glass holder 16. The guide rail 11, 11 and the window glass 15 of this window regulator are curved, in which the middle of the guide rail and the window glass are protruded to the outside of the car. The affixing structure 17 of this invention is used in the glass holder 16 and the carrier plate 18, 18' for coupling each other.

In the embodiment of FIG. 2*a*, four cable guides 12 and a pair of carrier plates 18, 18' of left and right are used, but it may be constructed with one carrier plate 18 which ascend and descend between pair of cable guides 12 of top and bottom. Further, it may not use the outer casing 14, and stretch the inner cable 13 approximately in liner between the cable guides 12. Moreover, in the case where the guide rail 11 is not used, the window glass 15 may be guided by the grass run (not shown) formed on the door of the carbody corresponding to the position of both side of the window glass 15.

Figure 3:
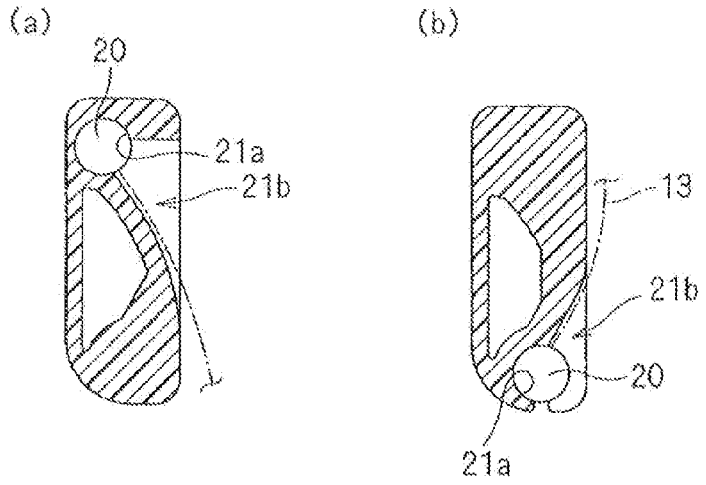
FIG. 3*a* is I-I line sectional view of FIG. 1*b*.
FIG. 3*b* is II-II line sectional view of FIG. 1*b*.

The inner cable 13 is made by twisting plural of metal wires. On one end of the inner cable where the carrier plate is fixed, the cable end 20 (see FIG. 3) having thin cylindrical shape is coupled. The cable end 20 is formed on the end of the inner cable 13 by pouring the metal into the dye with the end of the inner cable or by swaging.

The glass holder 16 has the channel having shape of U in cross section for nipping the bottom end of the window glass 15. The bottom part 16*a* which is a part of the U-shaped channel bottom is a portion which will be placed on the carrier plate 18. The fixing part 16*b* for fixing the glass holder 16 to the carrier plate 18 is protruding downwardly from the bottom end of the glass holder 16. The fixing hole 16*c* is formed on the fixing part 16*b* to be fixed to the carrier plate 18 by screw and bolt.

The carrier plate 18 includes main body 18*a* having plate shape, and the cable latching portion 21 having block shape protruding from the center and back of the main body 18*a*. The end rock part 21*a* for fixing the cable end of ascending inner cable and the end rock part 21*a* for fixing the cable end of the descending inner cable are formed in the cable latching portion 21 (see FIG. 3*a*, 3*b*). The end rock part 21*a* is communicated with the outside through the slit 21*b* formed on the side surface of the block shaped cable latching portion 21, and the inner cable 13 is being passed through the slit 21*b* to be fixed.

The adopting part 22 is formed on the both end of the main body 18*a* to guide the glass holder 16 which is brought down from upper side and to eventually fix the glass holder 16 (see FIG. 4*a*, 4*b*). The adopting part 22 includes the base portion 22*a* having a placement face 22*i* for placing the glass holder 16, the guide portion 22*b* which protrude upward from the side edge of the car interior side of the base portion 22*a*, the fixing portion 22*c* protruding downward from the other side edge.

The placement face 22*i* is formed horizontally for loading the glass holder 16 and supporting the weight of the window glass 15. The guide portion 22*b* is extended upward in a vertical direction from side edge of car interior side of the base portion, where the inner surface guide the fixing part 16*a* of the glass holder 16 (which will be mentioned later) and lead the glass holder 16 to the predetermined fixing position. The guide portion 22*b* is formed in the adopting part 22 formed on the left and right of the carrier plate 18. However, the guide portion 22*b* may be formed only in either side of the adopting part 22.

Figure 2:
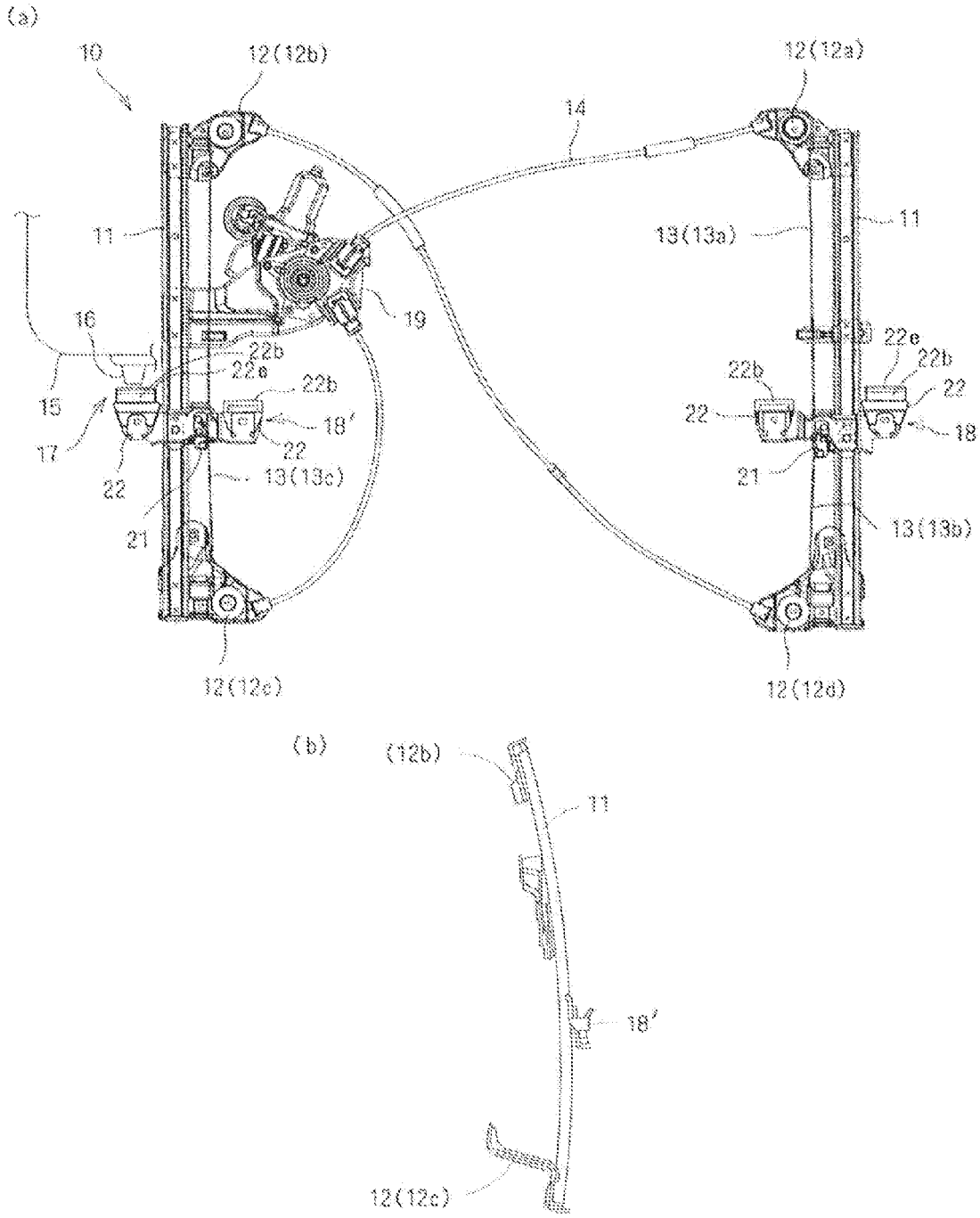
FIG. 2*a*, 2*b* is a front view and side view showing the embodiment of the window regulator of this invention.

As shown in FIG. 2, the guide portion 22*b* formed right side of the carrier plate 18, 18' is the guide portion of this invention, and it has inclined surface 22*e* on the top (see also FIG. 4*b*). The inclined surface 22*e* is slanted downwardly from window glass 15 side (car interior side) to placement face 22*i* side. It guides the glass holder 16 descending from upside to the placement face 22*i* side (car exterior side). The angle a of the inclined surface 22*e* against the vertical line is formed in 30 to 80 degree, preferably in 35 to 45 degree.

On the bottom end of the fixing part 16*b* of the glass holder 16, slope 16*d* is formed in the angle corresponding to the inclined surface 22*e* of the carrier plate (see FIG. 1). The angle of the slope 16*d* is formed in 30 to 80 degree, preferably in 35 to 45 degree (see angle β of FIG. 1*b*).

Figure 4:
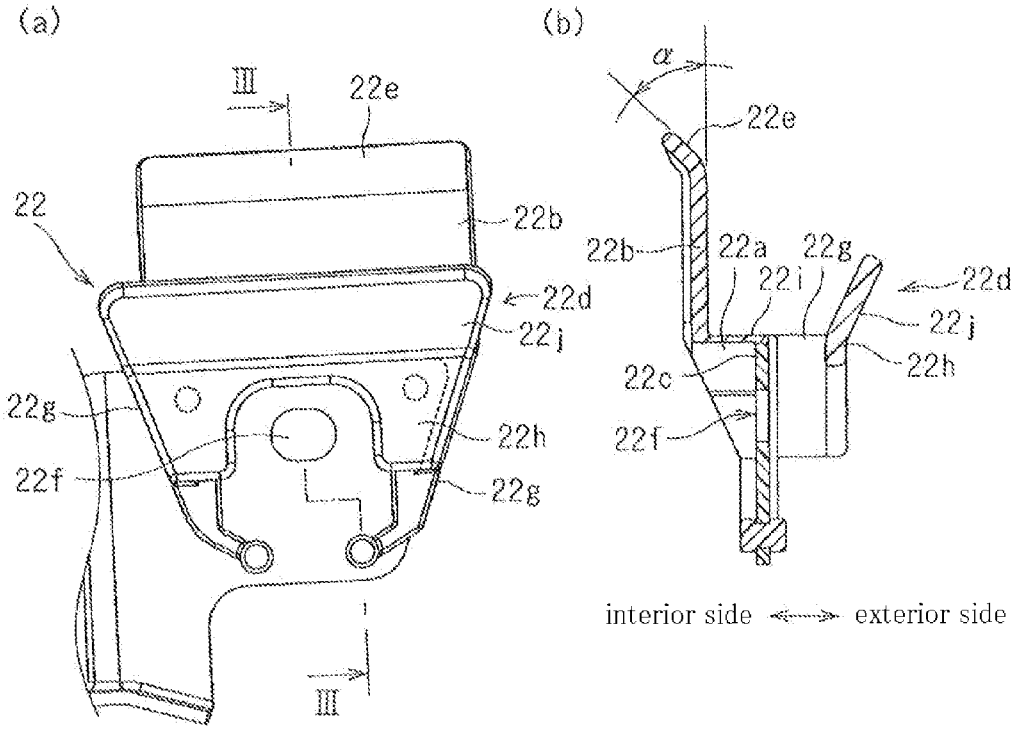
FIG. 4*a* is partially enlarged view of the installation part of the carrier plate.
FIG. 4*b* is III-III line sectional view.

As shown in FIG. 4, the penetrating hole 22*f* is formed on the fixing portion 22*c* for fixing the fixing part 16*b* of the glass holder 16. Especially, the adopting part 22 which has the inclined surface 22*e* is integrally formed with the fixing portion 22*c*. Further, it has storage portion 22*d* having cross-section shape of [C] and it has cylindrical configuration as a whole. The storage portion 22*d* has pair of side wall 22*g* protruding vertically from fixing portion 22*c*, the parallel portion 22*h* which joints the end of the side wall 22*g* and which is generally parallel to the fixing portion 22*c*, and the guide component 22*j* extending obliquely upward from the top of the parallel portion 22*h*. The area of cylindrical opening which is formed by the parallel portion 22*h*, the guide component 22*j* and the side wall 22*g*, is formed so as to spread heading upward. That is to say, the front and back surface of the fixing part 16*b* of the glass holder 16 is guided or supported by the fixing portion 22*c* and the parallel portion 22*h*, and the left and right surface is guided or supported by the side wall 22*g*, 22*g*. Therefore, the fixing part 16*b* of the glass holder 16 can be inserted into the opening of the storage portion 22*d*. Because, the storage portion 22*d* is formed on the upper side of the penetrating hole 22*f* of the fixing portion 22*c*, the bottom part of the fixing part 16*c* protrude from the bottom of the storage part 22*d*, when the fixing part 16*b* is inserted into the storage portion 22*d*. The glass holder 16 and the carrier plate 18 is fixed by penetrating the fastener member such as bolt to the fixing hole 16*c* protruding from the storage portion 22*d*.

Figure 5:
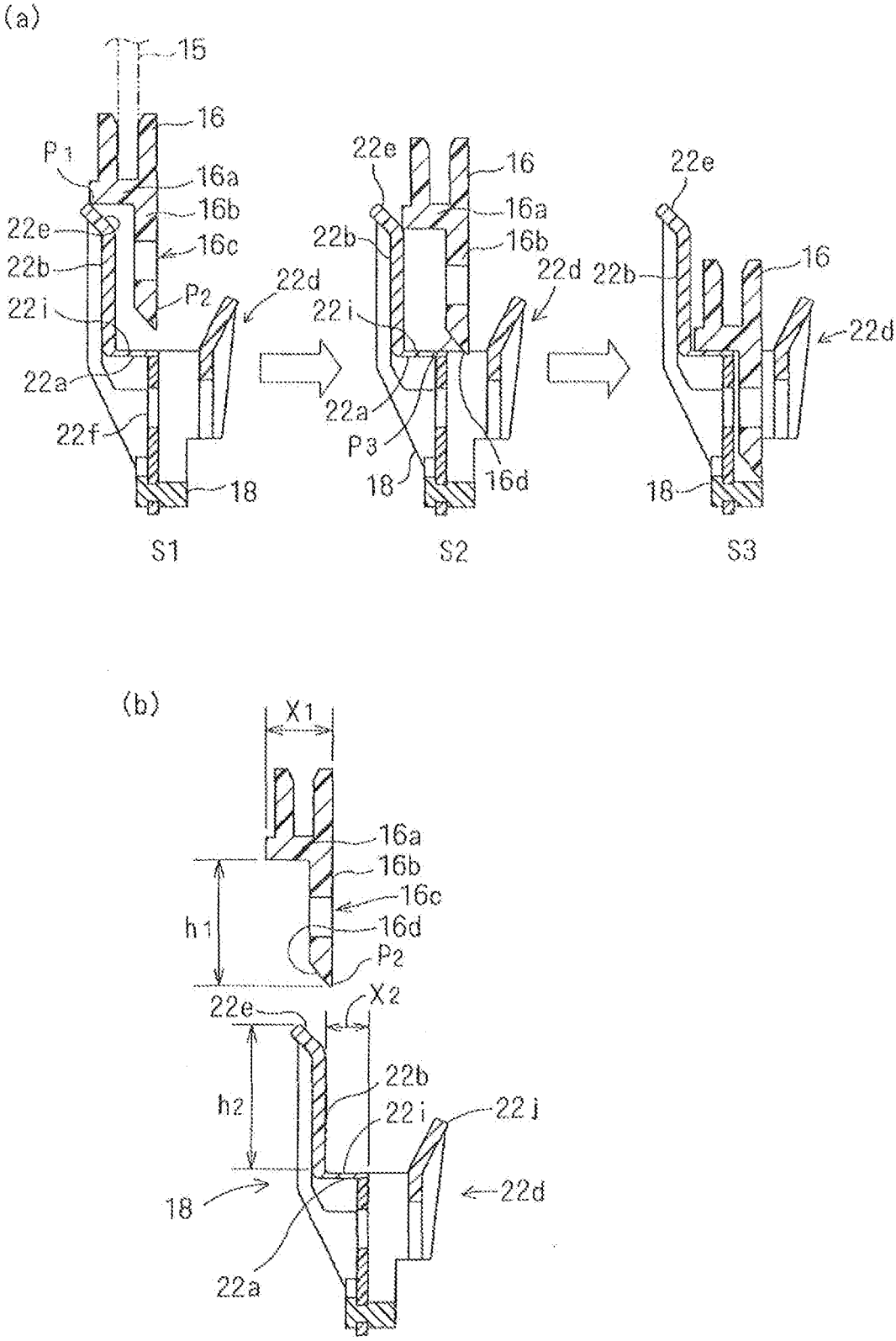
FIG. 5*a* is schematic view of window glass being fixed to the carrier plate by the affixing structure of this invention.
FIG. 5*b* is another schematic view of window glass being fixed to the carrier pate.
Figure 6:
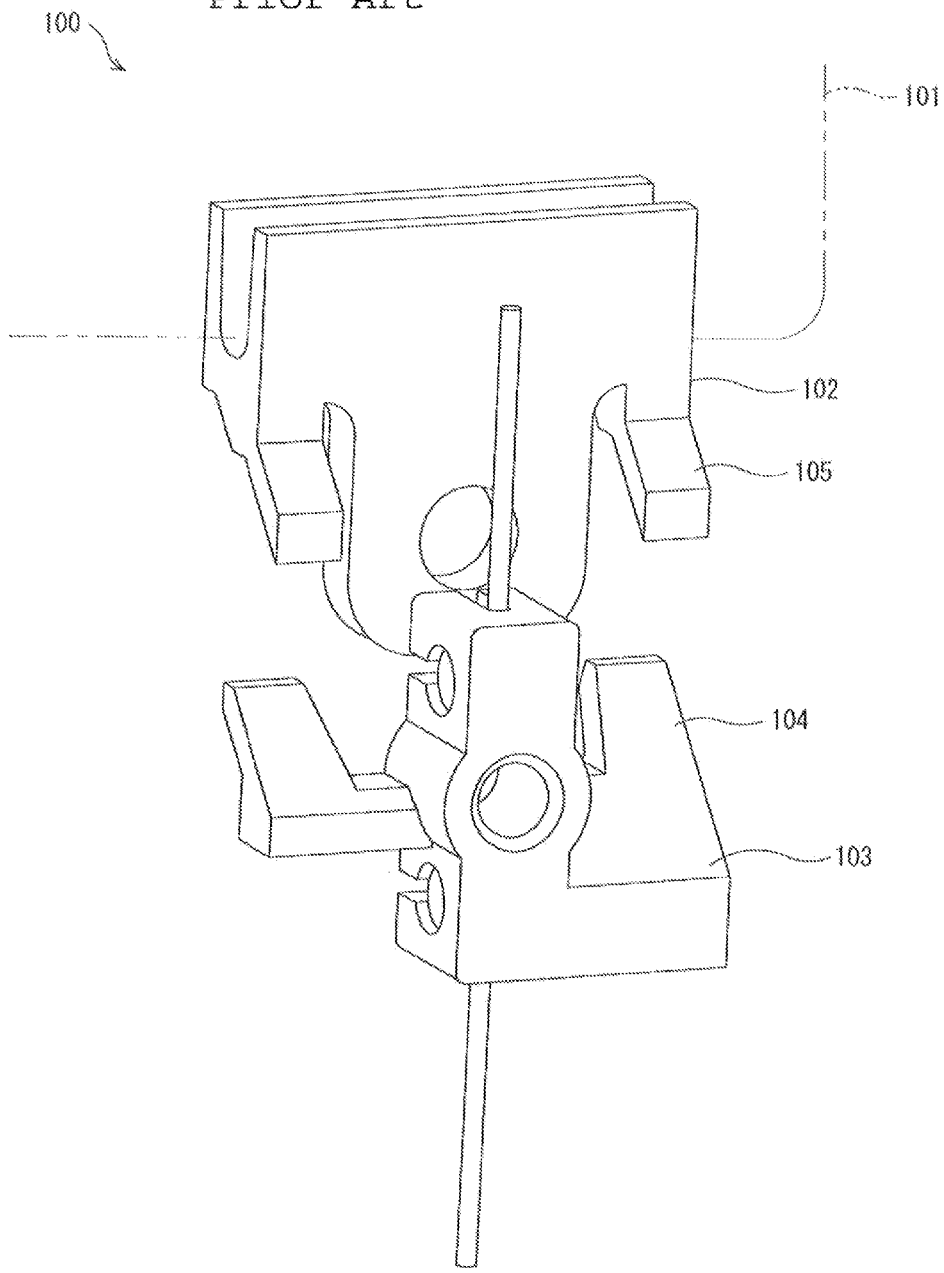
Fig.6 Prior Art
FIG. 6 is inclined view of prior art.
Figure 7:
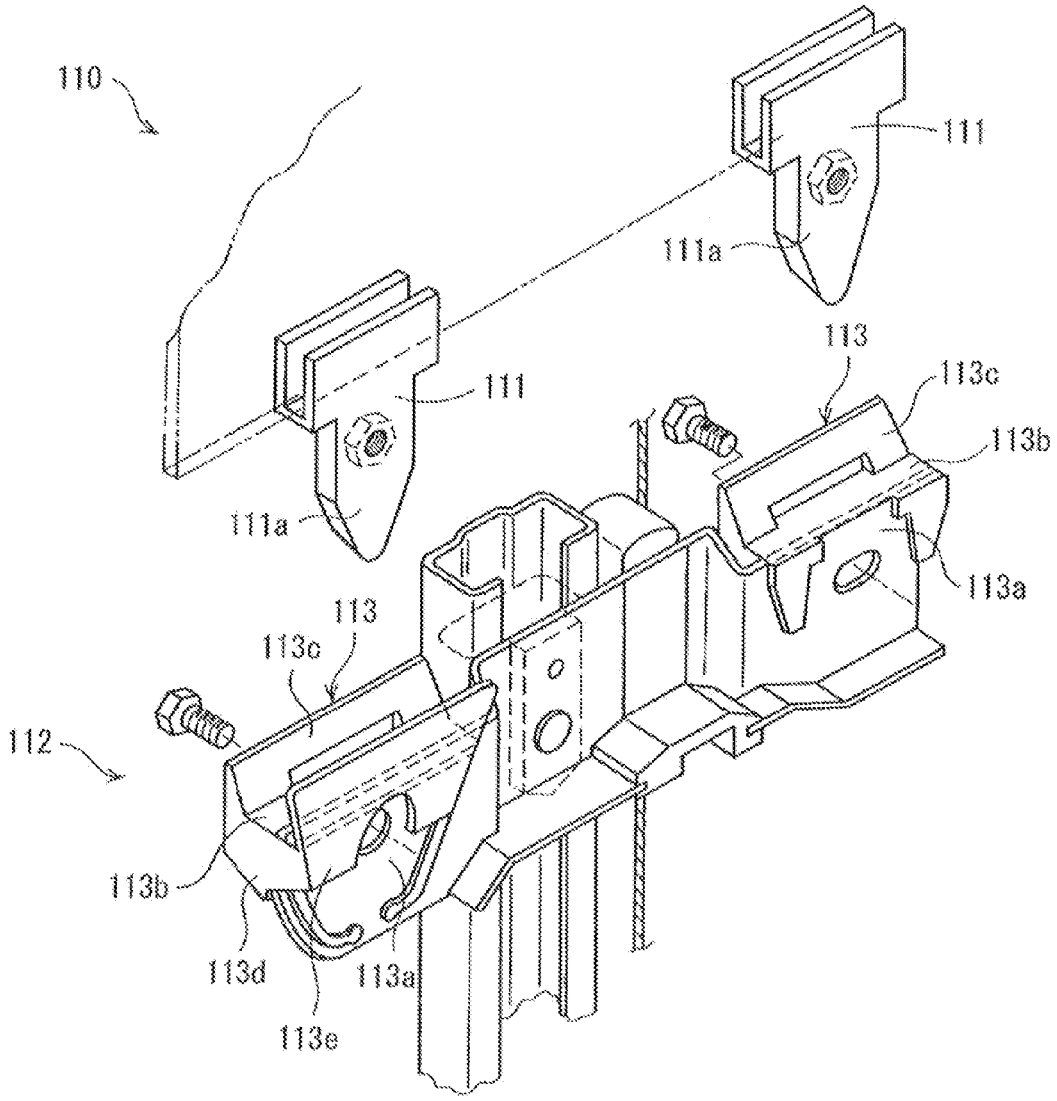
Fig.7 Prior Art
FIG. 7 is inclined view of prior art.

As shown in FIG. 5*b*, the mark 'X1' is the width of the window glass attached to the glass holder 16, and the mark h1 is the height of the fixing part 16*b* from the bottom part 16*a*. Further, the mark 'X2' is the width of the base portion 22*a* of the carrier plate 18 measured in parallel to the width direction of the window glass. The mark 'h2' is the height from the placement face 22*i* of the base portion 22*a* to the top of the inclined surface 22*e*. The width (X1) of the bottom part 16*a* of the glass holder 16 is set to be same with or larger than the width (X2) of the base portion 22*a* of the carrier plate. The height (h2) from the base portion 22*a* of carrier plate to the top of the inclined surface 22*e* is set to be same with or larger than the height of the fixing part 16*b* of the glass holder 16. By determining the dimension, the corner part P1 of the bottom part 16*a* meets the inclined surface 22*e* and avoid the contact of the bottom P2 of the fixing part 16*b* with the placing surface 22*i* when the glass holder 16 is lowered for placing on the carrier plate 18.

The carrier plate 18 and the glass holder 16 are each made of synthetic resin. For example, PBT (polybutylene terephthalate) or PET (polyethelene terephthalate) is preferable. Especially, synthetic resin having slide behavior, such as POM (polyoxymethylene) is preferable. Further, both can be made by bending the metal plate.

Next, the mechanism to fix the window glass 15 to the carrier plate 18 is explained using FIG. 5*a*. The window glass 15 in the figure is shifted to car interior side against the carrier plate 18 and the fixing part 16*b* of the glass holder 16 is located above the placement face 22*i* (condition S1). The corner part P1 of the bottom part 16*a* of the glass holder contact with the inclined surface 22*e* and drifted to the car exterior side following the inclined surface 22*e*. Therefore, the glass holder 16 can move to placement face smoothly (condition S2). And the bottom part 16*a* can be placed or set on the placement face 22*i* of the base part 22*a* (condition S3).

Even when the glass holder 16 is further shifted to the car interior side compared to FIG. 5*b* of the condition, for example even when the bottom end P2 of the fixing part 16*b* of the glass holder 16 is located above the inclined surface 22*e* of the carrier plate, the bottom end P2 will be shifted to the car exterior side following the inclined surface 22*e*. As a result the glass holder 16 can be drifted smoothly.

The explanation of the window regulator which uses the affixing structure of 17 shown in FIG. 2 is explained from here. The window regulator has four cable guides 12 provided in about square or rectangle. The cable guides 12 are constructed with the first pulley 12*a*, the second pulley 12*b* located on the left side of the first pulley, the third pulley (or the slide guide) 12*c* located below the second pulley 12*b*, and the forth pulley 12*d* located below the first pulley 12*a*. The first pulley 12*a* and the second pulley 12*b* are fixed on the top of the guide rails 11, 11, and the guide rail is fixed to the carbody.

The first carrier plate 18 and the second carrier plate 18' are located between the first pulley 12*a* and the forth pulley 12*d* and between the second pulley 12*b* and the third pulley 12*c* respectively. Therefore, the first carrier plate 18 and the second carrier plate 18' are guide by the guide rail 11, 11. The carrier plate 18, 18' support the bottom of the window glass 15 in the affixing structure 17.

The inner cable 13 is constructed by the first inner cable 13*a*, the second inner cable 13*b*, and the third inner cable 13*c*.

The first inner cable 13*a* is stretched from the cable latching portion 21 of the first carrier plate 18 to the drive unit 19. The first inner cable 12*a* extends upwardly from the carrier plate 18 to the first pulley 12*a*, which turn the direction in obliquely downward, to the drive unit.

The second inner cable 13*b* is stretched from the cable latching portion 21 of the first carrier plate 18 to the second carrier plate 18. The second inner cable 13*b* extends downwardly from the carrier plate 18 to the forth pulley 12*d*, which turn the direction in obliquely upward, and to the second pulley 12*b*, which turn the direction downward, and to the second carrier plate 18'.

The third inner cable 13*c* is stretched from the cable latching portion 21 of the second carrier plate 18' to the drive unit 19. The third inner cable 13*c* extends downwardly from the carrier plate 18' to the third pulley 12*c*, which turn the direction in obliquely upward, to the drive unit 19.

The end of the first and third inner cable 13*a*, 13*c* which is not fixed to the carrier plate is fixed to the drum (not shown) of the drive unit 19. The drive unit 19 carries the carrier plate 18, 18' upward and downward by pulling one of the inner cable 13*a*, 13*b* and sending the other.

The window regulator of FIG. 2*a* has total of four guide portion 22*b* on the left and right carrier plate 18, 18', each equipped with the pair set in left and right. The two endmost in the left side and the right side of the four guide portion 22*b* is the guide portion of present invention, which has inclined surface 22*e*, 22*e* on the top. However, the inclined surface 22*e* may be formed on the inner side guide portion 22*b* of the carrier plate 18, 18' in order to equip the character of the present invention. Further, the inclined surface 22*e* may be formed in both guide portions 22*b*, 22*b* of the carrier plate 18, 18'. In this case, it is effective to use in the window regulator which supports the window glass 15 with one guide rail and one carrier plate.

The invention claimed is:

1. An affixing structure for fixing a window glass to a carrier plate for a window regulator which is fixed to a carbody and which reciprocates the window glass by an inner cable, comprising;

a glass holder to be fixed to a bottom end of the window glass, and the carrier plate supporting the glass holder, wherein, the carrier plate has a base portion having a placement face for placing the glass holder, a guide portion which protrudes from one side edge of the placement face and which has a inclined surface formed on a top of the guide portion slanted downwardly heading the placement face, and a fixing portion which projects downwardly from other side edge of the placement face, the glass holder has a bottom part to be placed on the placement face, a fixing part which projects downwardly from the bottom part and which contacts with a periphery of the fixing portion for fixing, and when the glass holder is lowered for placing the glass holder on the carrier plate, the bottom part of the glass holder meets the inclined surface of the guide portion of the carrier plate, and then the bottom part of the glass holder is guided toward the placement face, before a front edge of the fixing part meets the placement face.

2. The affixing structure according to claim 1, wherein, a height of the guide portion is same with or larger than a height of the fixing, part, a width of the bottom part is same with or larger than a width of the base portion, a horizontal distance which the glass holder is moved by the inclined surface of the guide portion is same with or larger than the width of the bottom part.

3. The affixing structure according to claim 1, wherein the guide portion and the fixing portion are formed on both left side and right side of a cable anchoring portions of the carrier plate, the fixing part is formed on the glass holder corresponding to the guide portion and the fixing portion.

4. A window regulator comprising, a cable guide each set on a top and a bottom, an inner cable stretched between the cable guides, a driving unit to drive the inner cable, and the affixing structure of claim 1 for fixing the window glass to the carrier plate.

5. An affixing structure for fixing a window glass to a carrier plate for a window regulator which is fixed to a carbody and which reciprocates the window glass by an inner cable, comprising;

a glass holder to be fixed to a bottom end of the window glass, the carrier plate supporting the glass holder, wherein, the carrier plate has a base portion having a placement face for placing the glass holder, a guide portion which protrudes from one side edge of the placement thee and which has a inclined surface formed on a top of the guide portion slanted downwardly heading the placement face, and a fixing portion which projects downwardly from other side edge of the placement face, the glass holder has a bottom part to be placed on the placement face, a fixing part which projects downwardly from the bottom part and which contacts with a periphery of the fixing portion for fixing, and wherein, a height of the guide portion is same with or larger than a height of the fixing part, a width of the bottom part is same with or larger than a width of the base portion, a horizontal distance which the glass holder is guided by the inclined surface of the guide portion is same with or larger than the width of the bottom part.

6. A window regulator comprising, a cable guide each set on a top and a bottom, an inner cable stretched between the cable guides, a driving unit to drive the inner cable, and the affixing structure of claim 2 for fixing the window glass to the carrier plate.

7. A window regulator comprising, a cable guide each set on a top and a bottom, an inner cable stretched between the cable guides, a driving unit to drive the inner cable, and the affixing structure of claim 3 for fixing the window glass to the carrier plate.

* * * * *